US007708420B2

(12) United States Patent
Hartmann, Jr. et al.

(10) Patent No.: US 7,708,420 B2
(45) Date of Patent: May 4, 2010

(54) LIGHT FIXTURE

(75) Inventors: Richard Hartmann, Jr., Holland, MI (US); Richard Camarota, Holland, MI (US)

(73) Assignee: ITC, Inc., Holland, MI (US)

( * ) Notice: Subject to any disclaimer, the term of this patent is extended or adjusted under 35 U.S.C. 154(b) by 311 days.

(21) Appl. No.: 11/965,496

(22) Filed: Dec. 27, 2007

(65) Prior Publication Data

US 2008/0186716 A1 Aug. 7, 2008

Related U.S. Application Data

(60) Provisional application No. 60/877,938, filed on Dec. 29, 2006.

(51) Int. Cl.
*B63B 45/00* (2006.01)
*F21V 17/10* (2006.01)

(52) U.S. Cl. ..... 362/101; 362/477; 362/267

(58) Field of Classification Search ..... 362/96, 362/101, 153.1, 267, 364, 477
See application file for complete search history.

(56) References Cited

U.S. PATENT DOCUMENTS 5,556,188 A * 9/1996 Poppenheimer ..... 362/101
5,664,866 A * 9/1997 Reniger et al. ..... 362/477
6,241,361 B1 * 6/2001 Thrasher et al. ..... 362/101
6,250,776 B1 * 6/2001 Burkitt et al. ..... 362/267
7,029,139 B2 * 4/2006 McCarthy, III ..... 362/101
7,086,759 B2 8/2006 Hartmann, Jr. et al.
D544,979 S 6/2007 Hartmann, Jr. et al.
7,322,722 B2 1/2008 Hartmann, Jr. et al.
D561,374 S 2/2008 Hartmann, Jr. et al.

OTHER PUBLICATIONS

U.S. Appl. No. 29/270,699, Hartmann, Jr., Richard et al.

* cited by examiner

*Primary Examiner*—Stephen F. Husar
*Assistant Examiner*—Peggy A. Neils
(74) *Attorney, Agent, or Firm*—Miller, Canfield, Paddock and Stone; Timothy J. Engling

(57) ABSTRACT

A light fixture is provided which includes an improved connector arrangement between a fixture housing and a lens therefor. The connector arrangement includes a pre-mounted plunger cartridge which includes a cartridge body that mounts to the fixture housing and a resiliently biased plunger which projects through the fixture housing wall into releasable locking engagement with the lens.

18 Claims, 10 Drawing Sheets

LIGHT FIXTURE

This Application claims priority under 35 U.S.C. 119(e) to U.S. Provisional Application Ser. No. 60/877,938 filed on Dec. 29, 2006 which is incorporated by reference.

FIELD OF THE INVENTION

The present invention relates to a light fixture, and more particularly to a light fixture configured to be flush mounted on a surface.

BACKGROUND OF THE INVENTION

It is known to provide light fixtures for use in marine environments or other similar environments wherein moisture is encountered. Such light fixtures typically have a fixture housing which contains a light source therein, and a lens which mounts to the housing and permits the transmission of light therethrough. For such marine environments, it is preferred to include a sealing gasket between the lens and housing to prevent moisture from reaching the inside of the housing.

To join the lens to the housing, one type of known lens incorporates circumferential grooves therein which cooperate with leaf springs provided in the housing side wall which leaf springs resiliently engage the channels and releasably secure the lens to the fixture housing. Typically, such securement is accomplishment by inserting the lens into an initial position within the fixture housing and then rotating the lens into interlocked engagement with the leaf springs.

It is an object of the invention to provide an improved light fixture having an improved connector arrangement acting between the lens and fixture housing for releasably securing the lens thereto.

SUMMARY OF THE INVENTION

The invention relates to a light fixture including such an improved connector arrangement between a lens and fixture housing which permits engagement of the lens with the housing by initial insertion of the lens and subsequent rotation thereof to a locked position.

More particularly, the light fixture of the invention includes a can-like fixture housing having a peripheral rim at an open end thereof which rim projects radially outwardly and faces forwardly. The open end of the housing preferably defines a circular opening in which is received an annular mounting collar or skirt which projects rearwardly from the rear side of the lens and is adapted to fit within the circular open end of the housing in close relation therewith. The mounting collar or skirt includes circumferential locking channels which extend circumferentially and open sidewardly or radially towards the inside face of the housing fixture interior.

The improved light fixture further includes a plurality of plunger cartridges which each include a resiliently-biased, sidewardly-displaceable plunger disposed within a cartridge body. The plunger cartridges define an assembly comprising the cartridge body a plunger which extends sidewardly and a biasing member disposed in compression between the plunger and cartridge body which biases the plunger to an outwardly extended position but permits retraction of the plunger to an inwardly displaced position. Each plunger cartridge is individually mounted to the peripheral mounting rim of the fixture housing with the respective plunger thereof projecting through the housing side wall and extending into the open housing end for locking cooperation with the locking channels formed in the lens.

As will be discussed in further detail herein, these plunger cartridges and their cooperation with the fixture housing and associated lens defines an improved light construction providing an improved physical connection between the lens and housing and also providing an improved assembly process for this light fixture.

Other objects and purposes of the invention, and variations thereof, will be apparent upon reading the following specification and inspecting the accompanying drawings.

Figure 1:
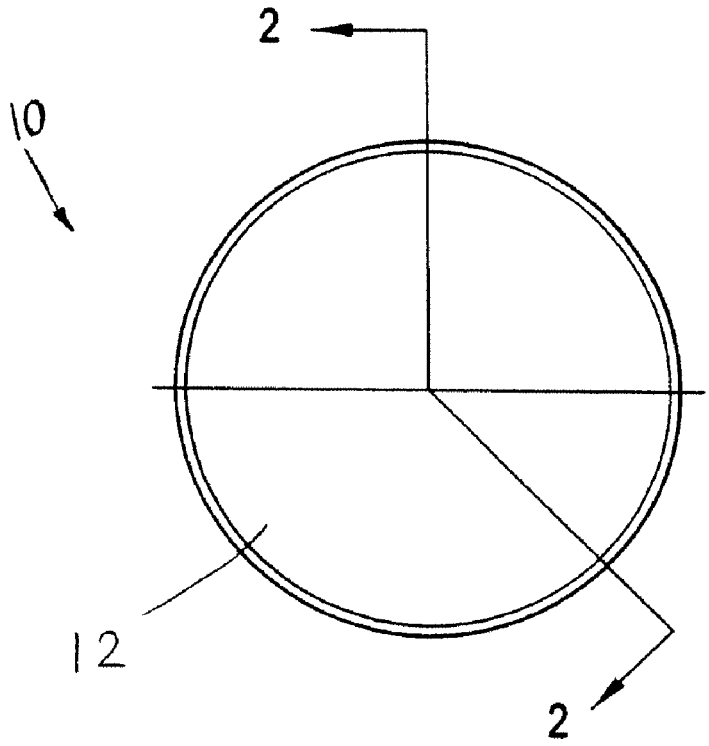
FIG. 1 is a plain view of a surface mount light fixture.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Figure 2:
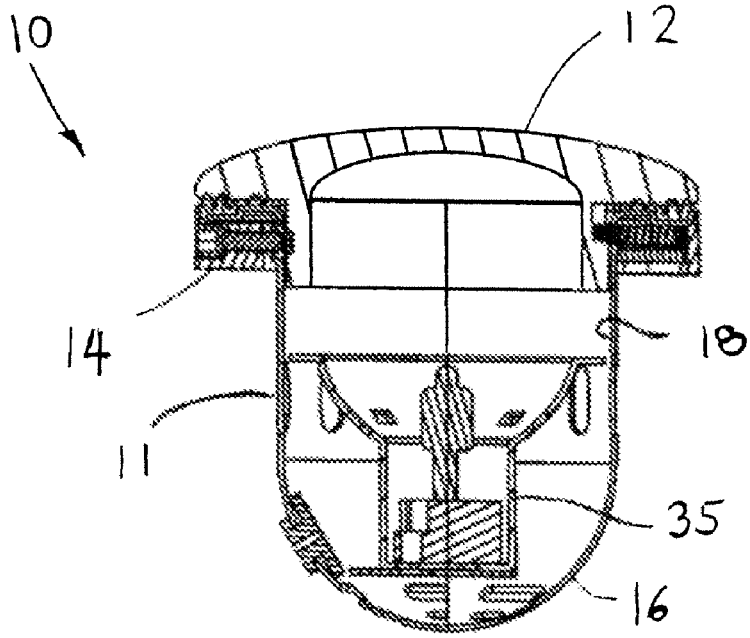
FIG. 2 is a side cross-sectional view of the light fixture as taken along line 2-2 of FIG. 1.

Referring to FIGS. 1 and 2, the invention relates to a first embodiment of a light fixture 10 which is configured to be flush mounted to a desired environmental surface of a structure which may be a barrier or other static structure such as a wall or ceiling of a dwelling, motor home, or boat cabin. The light fixture 10 is particularly suited for environments in which moisture would be encountered such as in a marine environment. The light fixture 10 generally comprises a can-like fixture housing 11, a light transmitting lens 12 and a ring-like mounting collar 14 which mounts to the fixture housing 11 and cooperates with housing 11 and the lens 12 to help secure the lens 12 to the fixture housing 11.

Figure 16:
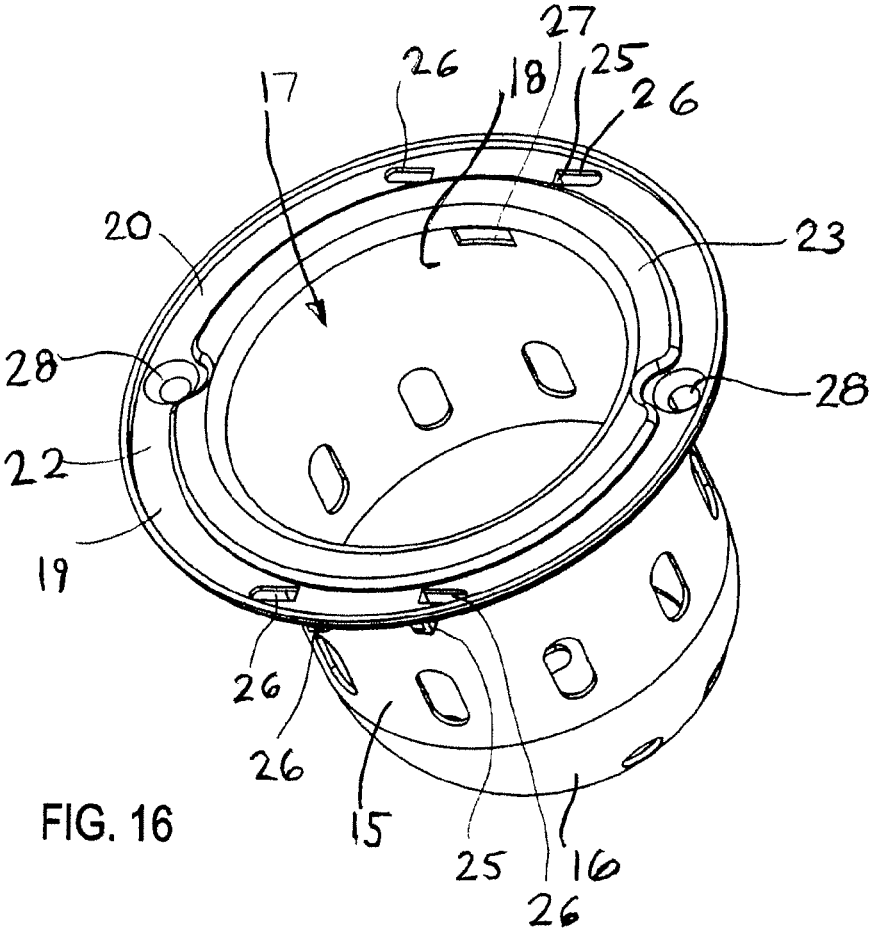
FIG. 16 is a perspective view of the fixture housing.
Figure 17:
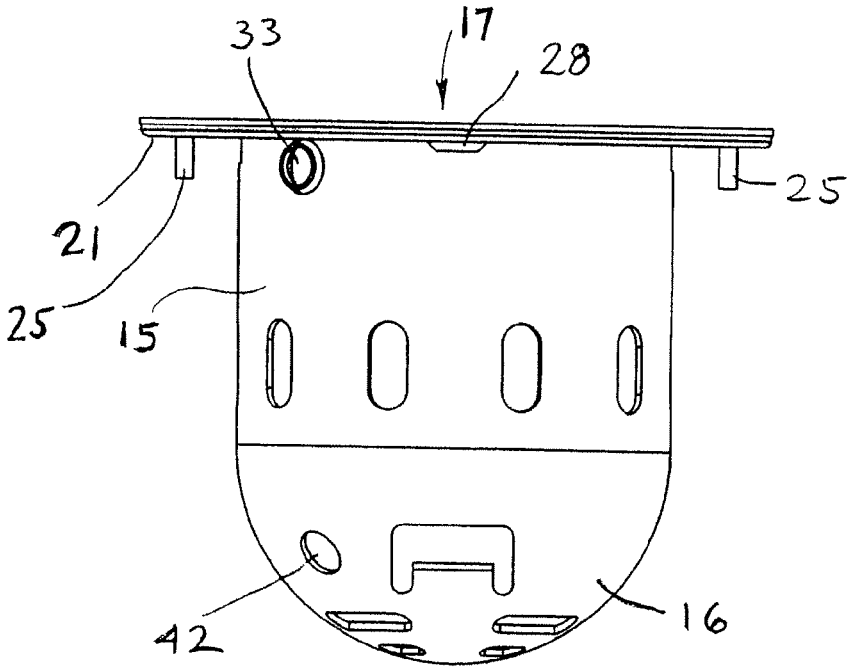
FIG. 17 is a side view of the fixture housing.

Referring to FIGS. 2, 16 and 17, the fixture housing 11 comprises a circumferential side wall 15 which is enclosed on a bottom end by a semi-spherical bottom wall 16. The opposite top end of the side wall 15 defines an open end 17 which is bounded by the interior side wall surface 18. As such, the open end 17 preferably has a circular shape as viewed from above that is sized so as to receive the lens 12 at least partially therein as will be described in further detail hereinafter. At the upper terminal edge of the side wall 15, an annular mounting flange 19 as provided which extends circumferentially around the periphery of the side wall 15 and projects radially outwardly therefrom so as to define a forward facing surface 20 that faces toward the lens 12, and an opposite rearward facing back surface 21 which faces towards the mounting ring 14.

Figure 8:
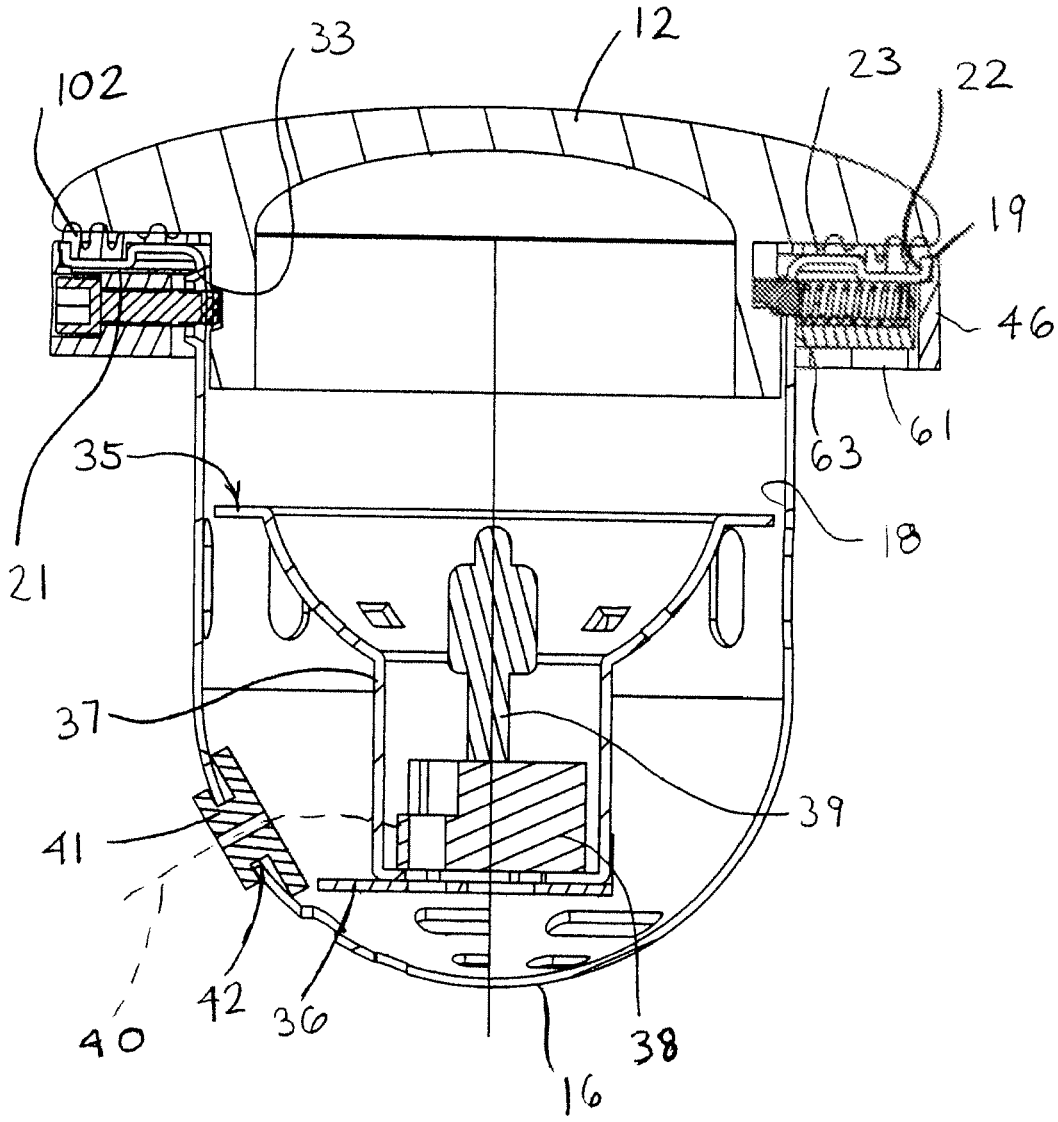
FIG. 8 is an enlarged cross-sectional view corresponding to FIG. 2.

As generally illustrated in FIGS. 8 and 16, the mounting flange 19 is stepped rearwardly in the middle thereof to define a shallow annular channel 22 which is defined radially outwardly of a flat land 23. In the region of the annular channel 22, the opposite sides of the rim 19 include respective pairs of connector tabs or fingers 25 which project rearwardly and are formed of the bendable material from which the flange 19 is formed. More particularly, the entire fixture housing 11 preferably is formed as a monolithic 1-piece structure of shaped metal, and preferably aluminum. In the region of the flange channel 22, the flange material is partially cut and then bent rearwardly in cantilevered relation to define L-shaped connector tabs 25 and as such, the formation of the tabs 25 results in the corresponding formation of narrow slots 26 in the flange material. During initial formation of the tabs 25, such tabs 25 typically are not yet bent into the L-shape generally seen in FIG. 16, which shape is subsequently formed by reforming of the tab 26 during assembly of the additional component parts as will be described in further detail herein. Additionally, a sideward opening, rectangular plunger window 27 is formed through the side wall 15 at a location generally centered between a respective pair of tabs 25.

In addition to the tabs 25, the annular flange channel 22 further includes at least two fastener bores 28 formed therethrough on diametrically opposite sides of the flange 19. These fastener bores 28 are further illustrated in FIG. 7 and are adapted to receive threaded fasteners 29 rearwardly therethrough for engagement or mounting of the light fixture 10 flush against the surface 30 of an environmental structure 31. Preferably, the flange 19 has a depressed, counterbore like shape at the bores 28 to receive the heads of the fasteners 29 so as to lie substantially flush with the channel 22.

Further as to the fixture housing 11, this housing 11 as illustrated in FIG. 17 also includes a locking bore 33 which projects sidewardly through the housing side wall 15.

Figure 7:
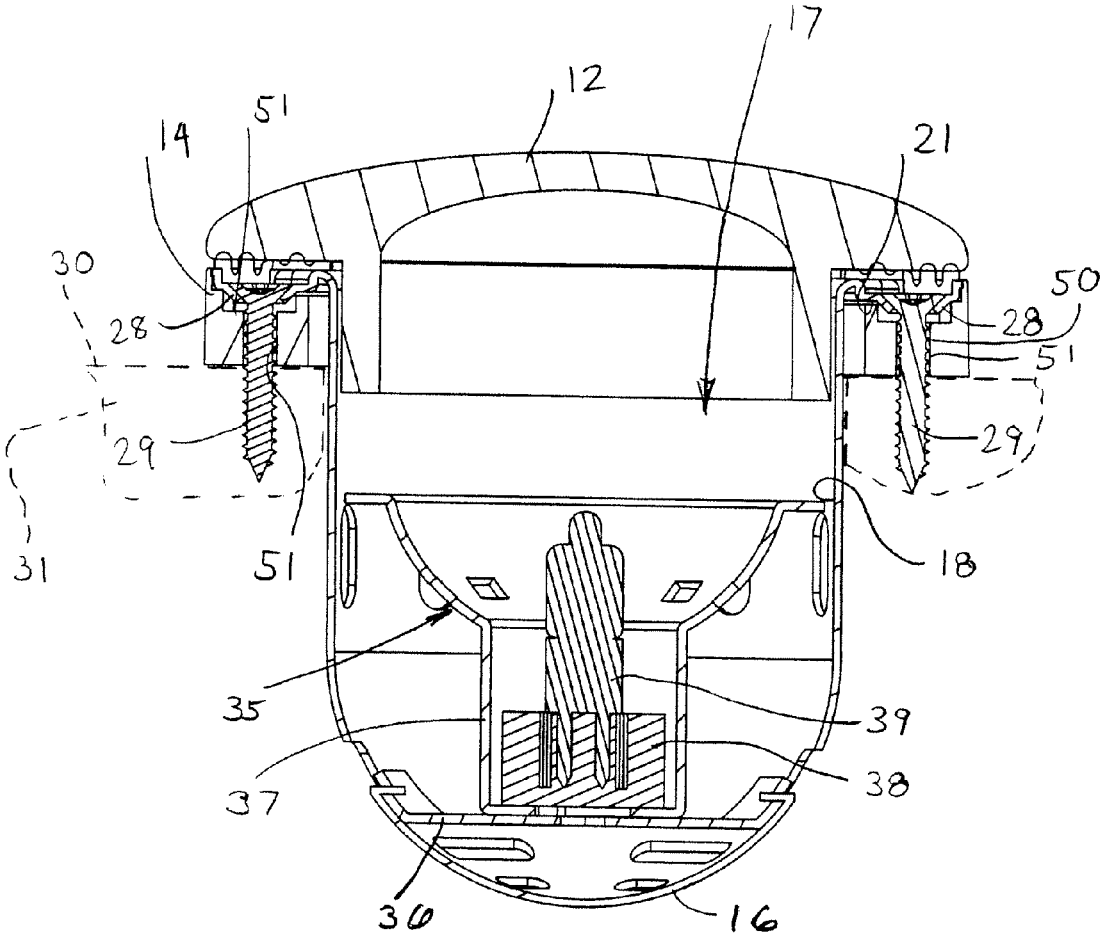
FIG. 7 is an enlarged side cross-sectional view of the light fixture of FIG. 3.

As to FIGS. 2, 7, and 8, the fixture housing 11 is part of a housing assembly in that a light assembly 35 is mounted interiorly therein. This light assembly 35 has a support bracket 36 extending cross-wise and supported by the bottom housing wall 16. The light assembly 35 further includes an aluminum reflector 37 which is supported by the bracket 36 and is aimed towards the open housing end 17, and a light socket 38 in turn is supported within the reflector 37 and has a light bulb 39 electrically and mechanically connected thereto. The light socket 38 is supplied with electric power from electric wires 40 which are diagrammatically illustrated in FIG. 8 and of any conventional structure. These electrical wires 40 exit the housing 15 through a rubber grommet 41 that is tight-fittingly mounted within a corresponding through passage 42 extending through the bottom housing wall 16. This basic housing sub assembly of the housing 15 and the light assembly 35 is usable in multiple configurations as described hereinafter.

Figure 3:
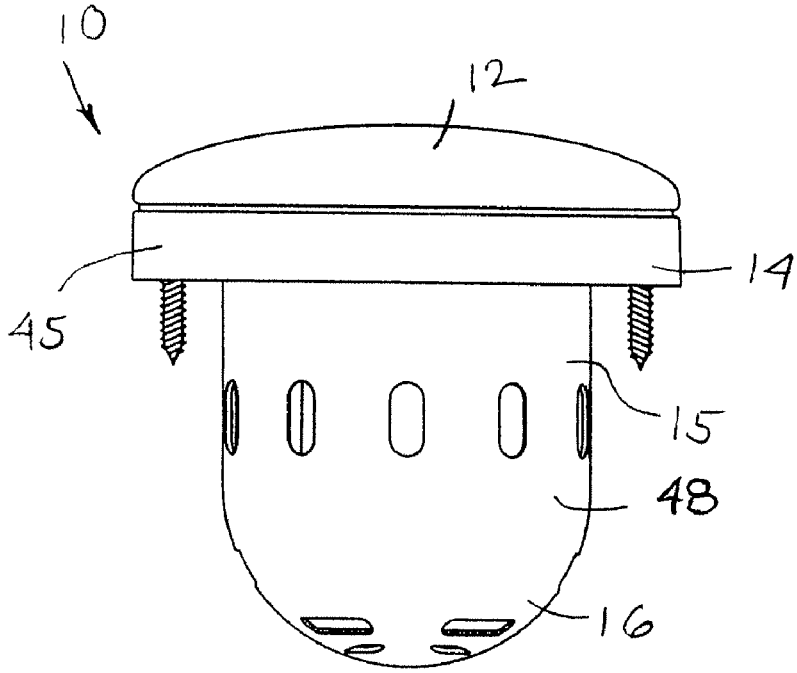
FIG. 3 is a side view of the light fixture.
Figure 4:
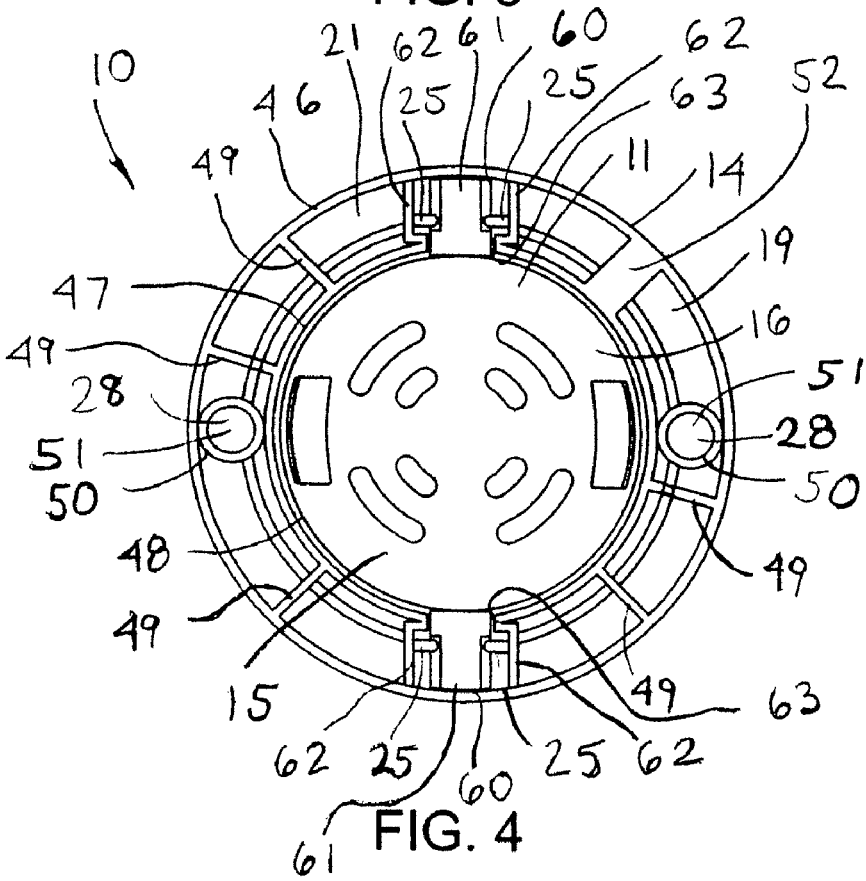
FIG. 4 is a bottom view of the light fixture.

More particularly as to FIGS. 3 and 4, a first primary embodiment of the invention includes the mounting collar 14 which is disposed on the rearward, back side of the housing mounting flange 19. The collar 14 preferably is formed of a plastic material having a suitable aesthetically pleasing color such as black since such collar 14 when mounted to the structure surface 20 (FIG. 7) remains exposed during use so that said collar 14 has a dual function of forming part of the overall aesthetic appearance of the light fixture 10 and also serves a structural function for facilitating mounting of the light fixture 10 to the structure surface 30 and also for assisting in interconnecting and engaging the lens 12 so as to secure same on the housing 15.

More particularly, the collar 14 preferably has a continuous circumferential outer surface 45 which faces radially outward and remains exposed when the fixture 10 is mounted in place. As seen in FIG. 4, the collar 14 in particular has a generally hollow construction defined by a circumferential outer wall 46 and a substantially continuous circumferential inner wall 47. The outer wall 46 and inner wall 47 are radially spaced away from each other wherein the inner wall 47 lies closely adjacent to but is spaced slightly from the opposing outer face 48 of the housing side wall 15. The outer and inner walls 46 and 47 are joined together radially by thin, radially extending webs 49. The interconnected webs 49 and walls 46 and 47 are preferably formed together as a single unitary-piece of a suitable plastic material so as to be structurally rigid with open regions or pockets being formed circumferentially and radially between such web and wall structures. When assembled, the collar 14 lies closely against the back face 21 of the annular housing flange 19 as can be seen in FIGS. 4 and 7.

The collar 14 further includes cylindrical tubes 50 which define bores 51 that are positioned in registry or coaxially aligned with the corresponding fastener bores 28 formed in the flange 19. As such, the fasteners 29 extend through both the fastener bores 28 and the aligned bores 51 so as to pass therethrough as seen in FIG. 3 for engagement with the environmental structure 31. In this manner, the light fixture 10 is mountable to the environmental structure 31 by the fasteners 29 with the collar 14 being sandwiched or disposed between the environmental surface 30 and the housing flange 19. With the collar 14 positioned against the flange 19, preferably an additional adhesive material such as a silicone adhesive is provided therebetween to not only provide fixed securement of the collar 14 to the flange 19, but also to prevent the passage of water at the juncture between the collar 14 and flange 19.

Figure 10:
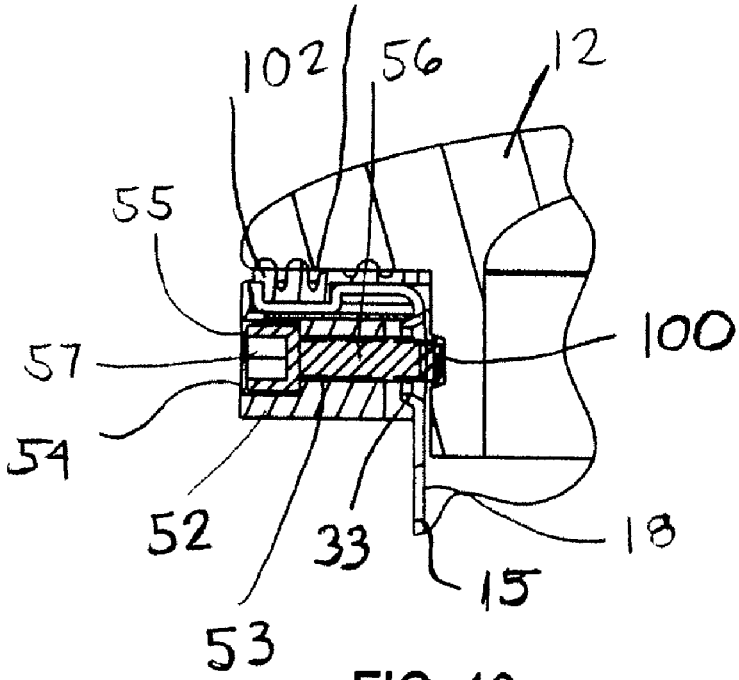
FIG. 10 is a fragmentary cross-sectional view of a locking screw arrangement for the light fixture.

Referring to FIGS. 4, 8 and 10, the collar 14 also preferably includes an enlarged support block 52 extending radially between the outer and inner walls 46 and 47 in one quadrant thereof. FIG. 4 illustrates a bottom view of this support block 52, while FIGS. 8 and 10 illustrate cross-sectional views thereof. As seen in FIG. 10, the support block 52 is formed substantially solid throughout except for the formation of a first bore portion 53 which extends horizontally, sidewardly therethrough and aligns with the locking bored 33 of the housing 15. The outer portion of the support block 52 further includes an enlarged-diameter, second bore portion 54 wherein these bore portions 53 and 54 are adapted to threadedly receive a locking screw 55 therein as seen in FIG. 10. The locking screw 55 includes a threaded shank 56 that threadedly engages with the first bore portion 53, and an enlarged head portion 57 which fits within the bore portion 54 and is rotatably driven by a suitable driving tool. FIG. 10 illustrates the locking screw 55 in an extended, locked position with the inner end of the shank 56 being seated within a corresponding recessed portion of the lens 12 to prevent rotation of the lens 12. A more detailed discussion of the locking cooperation between the screw 55 and lens 12 will be provided hereinafter.

Figure 18:
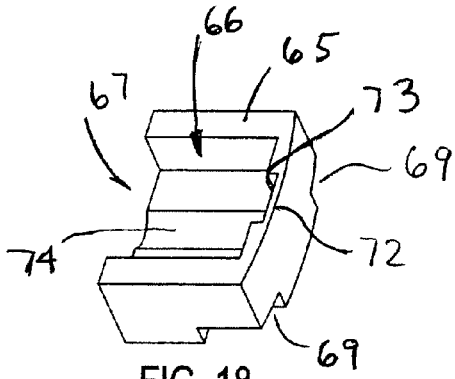
FIG. 18 is a perspective view of the cartridge body.
Figure 19:
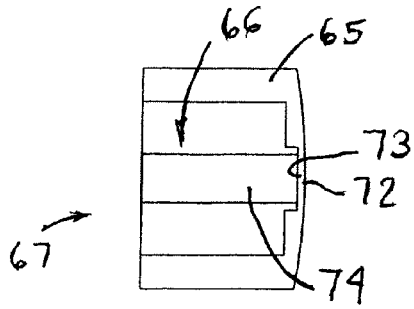
FIG. 19 is a plan view of the cartridge body.

Referring again to FIG. 4, the collar 14 also is provided with two mounting pockets 60 on diametrically opposite sides thereof which are each adapted to receive respective plunger cartridge assemblies 61 therein. Each pocket 60 is defined by a pair of pocket side walls 62, which are circumferentially spaced apart, and is closed off by the outer wall 46 but has an open interior end 63 formed by a gap in the inner wall 47. These cartridge assemblies 61 are mounted to the flange 19 and cooperate with the lens 12 to releasably engage the lens 12 to the housing 15. As to the cartridge assembly 61, each cartridge assembly 61 is adapted to be fixedly secured to the housing mounting flange 19 by the above-described tabs 25. Referring more particularly to FIGS. 4, 9 and 18-21, the cartridge assembly comprises a cartridge body or housing 65 which is generally block-shaped and has a plunger chamber 66, which opens upwardly and sidewardly from an open end 67. As seen in FIG. 18, the outer bottom corners of the body 65 include rectangular securement notches 69, wherein the body 65 is configured to be initially positioned beneath the mounting flange 19 in the position generally illustrated in FIG. 9, after which, the connector tabs 25 are then bent into the body notches 69 to trap and secure the cartridge assembly 61 to the bottom of the mounting flange 19. In this position, the inner end of the body 65 lies closely adjacent to the housing wall 15 with the plunger chamber 66 being aligned sidewardly with the corresponding plunger window 27 formed in such side wall.

Figure 9:
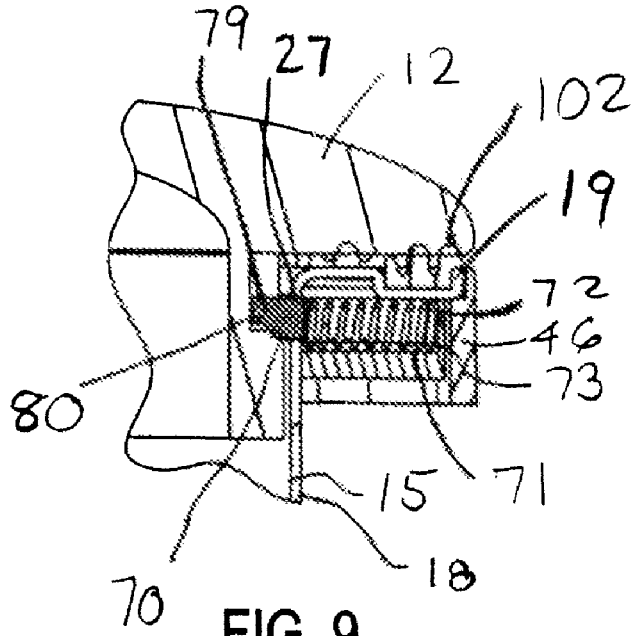
FIG. 9 is a fragmentary cross-sectional view of the cartridge assembly mounted to the fixture housing and cooperating with the fixture lens.

As seen in FIG. 9, the cartridge assembly 61 further includes a horizontally slideable plunger 70 which is resiliently biased by a biasing member 71, preferably formed as a coil spring, which is disposed in compression between the end wall 72 of the plunger chamber 66 and the plunger 70 itself. More particularly, the chamber end wall 72 is formed with a sideward opening spring pocket 73 which receives the outer end of the spring 71 therein, and the bottom surface of the plunger chamber 66 also includes a shallow arcuate guide channel 74 (FIGS. 18 and 19) along which the spring 71 extends.

Figure 20:
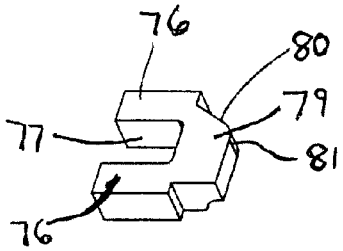
FIG. 20 is a perspective view of a cartridge plunger.
Figure 21:
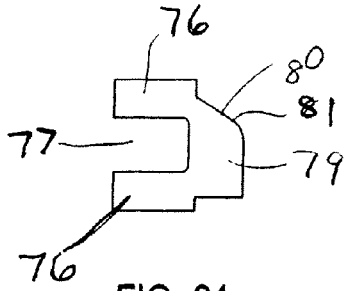
FIG. 21 is a plan view thereof.

As to the plunger 70, such plunger 70 is illustrated in greater detail in FIGS. 9, 20 and 21. This plunger 70 has a generally U-shaped profile (when viewed from above) that is defined by parallel, spaced-apart plunger legs 76 which define a spring-receiving gap 77 therebetween. The legs 76 are joined together by a cam leg 79 that extends sidewardly thereacross and joins the legs 76 together into the rigid U-shaped profile. This cam leg 79 includes a projecting cam portion 80 that is defined by an inclined surface 81 wherein the cam portion 80 and associated cam surface 81 project through the plunger window 27 for engagement with the lens 12 as generally illustrated in FIG. 9. This plunger 70 is horizontally slideable within the plunger chamber 66 and therefore may be in the fully extended position illustrated in FIGS. 9, 18, and 19 or may be depressed inwardly against the spring 71 to at least a partially retracted position to permit removal of the lens 12.

During assembly, the plunger 70 and spring 71 are initially assembled together and positioned within the plunger chamber 66 of the cartridge body 65 which cartridge assembly 61 is then positioned against the back surface 21 of the housing mounting flange 19 in the position generally illustrated in FIGS. 8 and 9. In this position, the cartridge body 65 is disposed, downwardly depending, circumferentially between a respective pair of the connector tabs 25 which tabs 25 are initially in their unbent, straight condition, and then once the cartridge assembly 61 is located therebetween, the ends of the tabs 25 are bent to the L-shaped profile referenced above. These connector tabs 25 hence are bent into the securement notches 69 to effectively grip and hold the cartridge assembly 61 in rigid engagement with the housing mounting flange 19. Notably, the tabs 25 not only draw and restrain the cartridge assembly 61 against the back flange surface 21, but they also locate the cartridge assembly 61 radially or sidewardly so as to lie closely against the side face of the housing side wall 15. In this position, the plunger 70 projects through the respective window 27 and into the open end 17 of the housing 11 in a fully extended position which allows for free insertion of the lens 12 into such open end 17. However, the plungers 70 as will be described hereinafter, also are at least partially retractable so as to permit rotation of the lens 12 to a locked position which locking lens rotation effects a partial retraction of the plunger 70 which plungers 70 then tight fittingly grip the lens 12 to hold same in a fully seated position within the housing 11. Such engagement of the lens 12 with the plungers 70 will be described in further detail hereinafter.

It is noted that the cartridge assembly 61 is initially pre-mounted to the mounting flange 19, and after which, the collar 14 is then mounted in place on the flange 19. This is accomplished by aligning the cartridge pockets 60 of the collar 14 with the respective cartridge assemblies 61 and then as the collar 14 is moved against the flange face 21, the pre-mounted cartridge assemblies 61 then fit into and align with said pockets 60. As mentioned above, a suitable water resistant adhesive is provided between the collar 14 and flange 19 to fixedly secure same thereto. As seen in FIG. 4, the inner most end of the cartridge body 65 is able to be positioned within the respective opening 63 formed in the inner collar wall 47 so that the plunger 70 is able to pass through the plunger window 27.

With this arrangement, the collar 14 thereby also serves as a spacer between the flange 19 and the environmental structure surface 31, while the collar 14 also defines storage pockets 60 which hides the cartridge assemblies 61 that are notably positioned exteriorly of the environmental structure surface 31.

Figure 5:
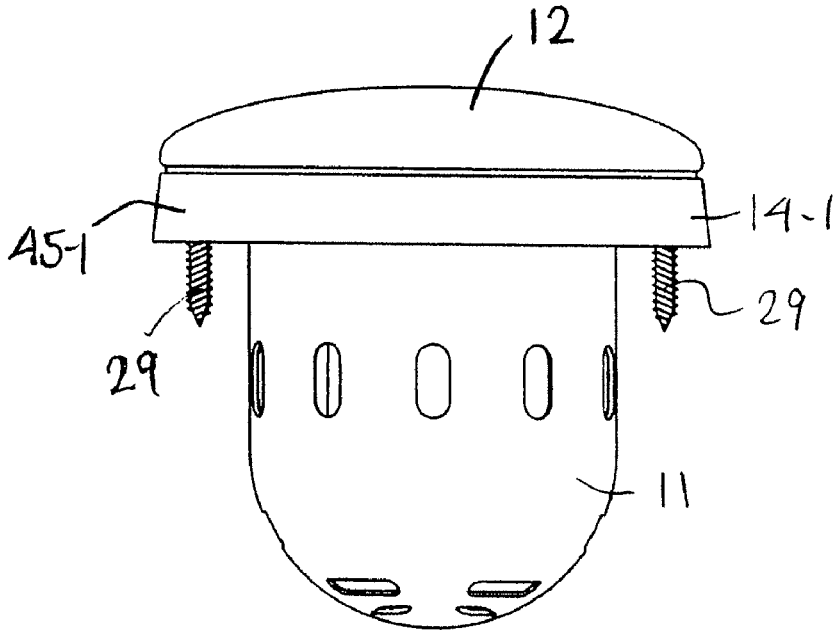
FIG. 5 is a side view of a second embodiment of the surface mount light fixture.
Figure 6:
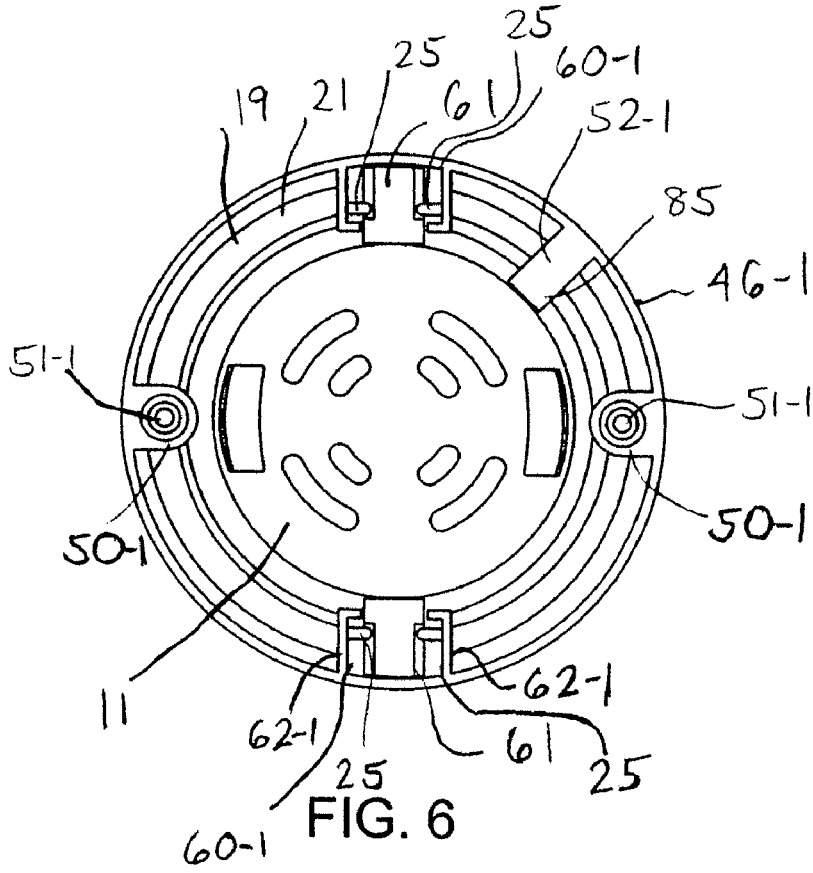
FIG. 6 is a bottom view thereof.

The collar 14 also provides additional advantages as depicted in FIGS. 5 and 6. More particularly, an alternate collar 14-1 is illustrates which is formed so as to be readily interchanged with the above-described collar 14. This collar 14-1 may have a different aesthetic appearance, and preferably, for example, is formed of a cast metal material having a desirable aesthetic finish applied to or formed on the exterior surface 45-1 thereof. It is understood, that the housing 11, lens 12 and the additional components such as the fastener 29 and cartridge assemblies 61 are all formed identical to the above-described components and hence, the following discussion of collar 14-1 merely addresses the structural differences thereof as compared to the collar 14.

More particularly as to FIGS. 5 and 6, the collar 14-1 preferably has a highly polished, metallic appearance thereto such as a corrosion resistant, chrome-like finish on surface 45-1 to provide a desirable aesthetic appearance.

As seen in FIGS. 5 and 6, the collar 14-1 includes an outer wall 46-1 that extends circumferentially and defines the outer surface 45-1. It is noted that an inner wall such as wall 47 does not need to be provided in this rigid metal structure of the collar 14-1 and hence, while a support block 52-1 is provided for supporting the locking screw 55, such support block 52-1 projects radially inwardly to a free end 85 thereof. Additionally, a pair of fastener supports 50 are provided which extend radially inwardly and define fastener bores 51-1 for the fasteners 29.

Space circumferentially therefrom, additional pocket walls 62-1 are provided which project readily inwardly and define a pocket 60-1 that is configured to receive a respective cartridge assembly 61 in the same manner as previously described above. In particular, the cartridge assemblies 61 are pre-mounted by the connector tabs 25 to the mounting flange 19 and then the collar 14-1 is mounted to the flange 19 by a suitable water resistant adhesive.

Therefore, as can be seen, a common housing assembly is provided comprising the fixture housing 11, light assembly 35, and cartridge assemblies 61 which join together in combination with the demountable lens 12. This basic combination may then be provided in combination with either of the collars 14 or 14-1.

Figure 11:
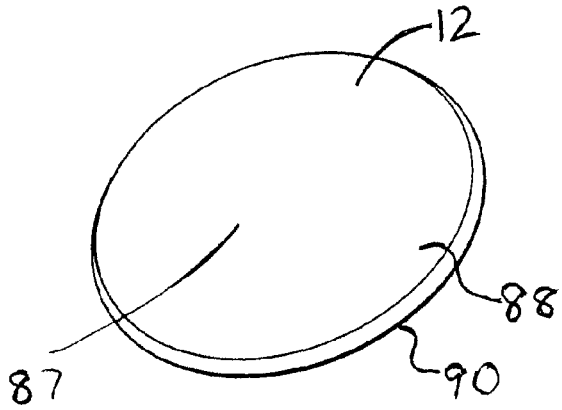
FIG. 11 is a perspective view of the fixture lens.
Figure 12:
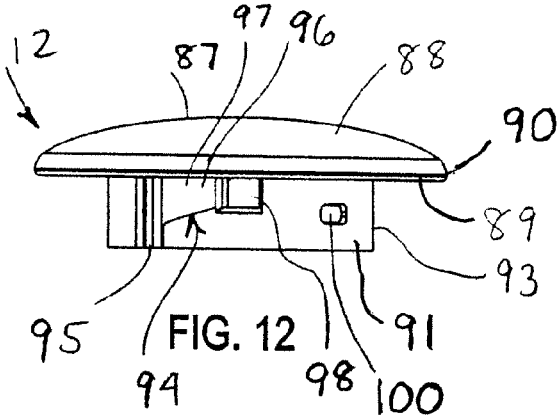
FIG. 12 is a side view thereof.
Figure 13:
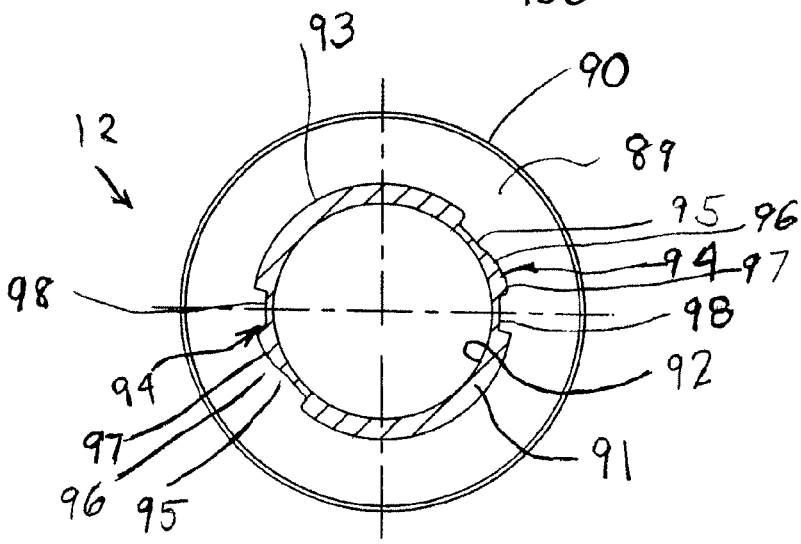
FIG. 13 is a bottom cross-sectional view thereof.

Turning first to the lens 12 as illustrated in FIGS. 11-13, the lens 12 generally comprises a main lens body 87 having a convex outer surface 88 which is exteriorly exposed during use and a flat planar surface 89 which faces rearwardly and extends about the outer peripheral lens edge 90.

Also on the back side of the lens 12, an annular, coaxial skirt 91 is provided which is defined by a continuous circular or circumferential inner surface 92 and a discontinuous, profiled outer surface 93 which includes various formations therein that allow for the connection of the lens 12 to the fixture housing 11 through cooperation with the cartridge assemblies 61 and in particular, through direct cooperation of the plungers 70 as well as the locking screw 55 with these formations in the lens skirt 91.

More particularly, the skirt 91 is formed with a pair of L-shaped grooves 94 which extend circumferentially a partial distance about the circumference of the skirt 91 and are disposed on diametrically opposite sides thereof. The grooves 94 each include a rearward opening entry channel 95 which is adapted to align with the plungers 70 and permit the plungers 70 to be slid into the entry channels 95 with the plungers 70 in the extended position. The entry channels 95 further have forward ends which open into one end of a circumferential channel 96 that allows for the lens 12 to be rotated when seated in the open housing end 17 wherein the stationary plungers 70 essentially slide along the length of these circumferential channels 96.

These channels 96 have a raised portion 97 in the middle thereof and a deeper recessed portion 98 at the blind end. Hence, during rotation of the lens 12, the plungers 70 essentially travel along and are depressed outwardly as they reach the raised portion 97 by contact of the inclined surface 81 of the cam portions 80 which ride along the opposed groove surface, and the plungers 70 then are able to re-extend back into the recessed portions 98 which provides positive securement of the lens 12 in the fully rotated engagement position which position is defined by the point at which the plungers 70 fully seat within the recessed portions 98. It is noted that FIG. 13 diagrammatically illustrates the middle channel portion 97 as having a noticeably pronounced height relative to the portion 96 for illustrative purposes, with it being understood that such raised portion 97 may have a dimension which more closely approximates the entry channel 95 so long as the recessed portion 96 has a noticeable drop off to positively seat the plungers 70 therein. This seating of the plungers 70 and the recessed portions 96 does provide for positive locking of the lens 12, although reverse rotation of the lens 12 is still permitted with sufficient reverse rotational force.

In view of the foregoing, to prevent inadvertent reverse rotation of the lens 12, an additional locking recess 100 is provided in skirt 91. FIG. 12 illustrates one such recess 100 with it being understood that a second recess 100 is also located on the diametrically opposite side of the skirt 91 wherein only one recess 100 is engaged by screw 55 but both recesses 100 being provided so that the grooves 94 can be aligned with the plungers 70 in either orientation and the screw 55 will align one of the recesses 100. Referring again to FIG. 10, one locking recess 100 ends up being aligned with the corresponding locking screw 55 when the lens 12 is in the final rotated position discussed above. As such, driving of the locking screw 55 to the fully seated position of FIG. 10 places the free end of the screw 55 in the recess 100 and the cooperation of these two rigid structures prevents any reverse lens rotation.

In the foregoing manner, the lens 12 is positively seated in engagement with the fixture housing 11 and while locking is affected by the screw 55, such screw 55 may also be disengaged to permit ready removal of the lens 12 where appropriate.

By the use of the individual plastic plungers 70, such plungers 70 not only are readily mountable to the housing 11 through the use of the cartridge assembly 61, but also are formed of a substantially rigid plastic material that provides improved positive locking between such plunger 70 and the lens 12 which is formed of rigid glass or other suitable translucent, rigid material like plastic.

Figure 14:
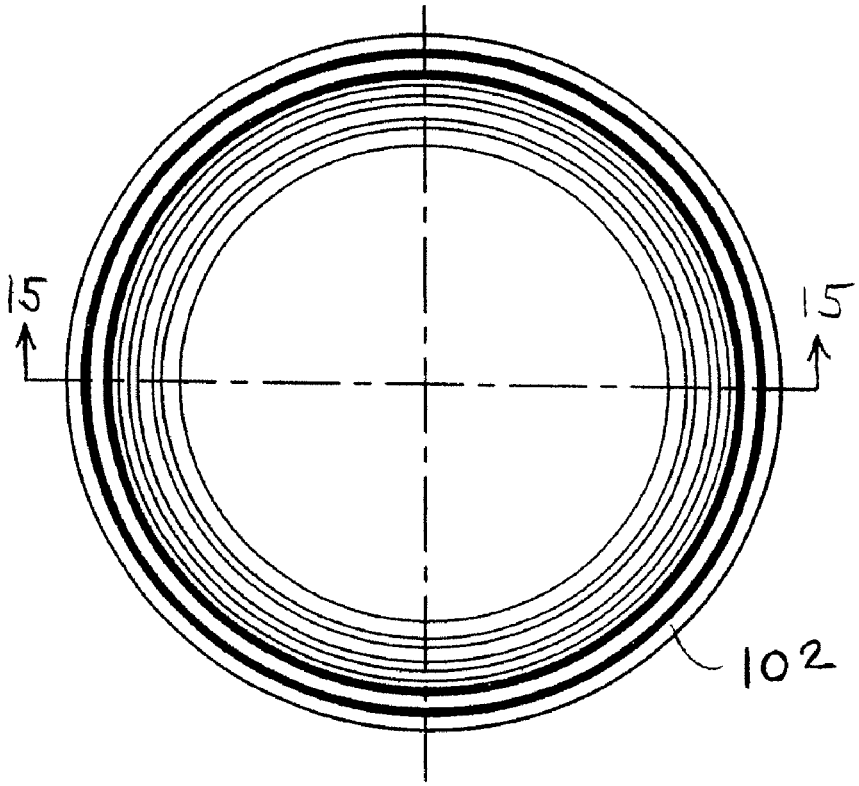
FIG. 14 is a plan view of a gasket.
Figure 15:
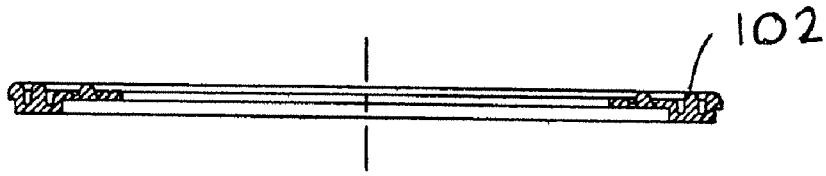
FIG. 15 is a side cross-sectional view thereof as taken along line 15-15 of FIG. 14.

Referring to FIGS. 14 and 15, the light fixture 10 of the invention also includes an annular elastomer gasket 102 which is compressed or sandwiched between the opposing lens face 89 and the housing mounting flange 19 as seen in FIGS. 8-10. This gasket 102 not only provides a water tight seal but also provides resistance to turning of the lens 12 to further assist in resisting reverse lens rotation.

With the foregoing arrangement, the same common component structures for the fixture housing 11 and lens 12 may be provided in multiple embodiments which provides an improved light construction that not only provides an improved connection between the lens 12 and housing 11 but also provides for ready adaptation of this housing/lens assembly in multiple configurations through the use of the collar constructions 14 and 14-1.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A light fixture mountable on an environmental structure, comprising:

a fixture housing having a side wall with an interior wall surface and an exterior wall surface and having an opening at a housing end which is defined by said interior wall surface proximate a side wall edge;

a light source disposed in said fixture housing so as to transmit light forwardly from said opening;

a light transmitting lens which fits into and overlies said opening and said light source disposed in said fixture housing, said lens including an engagement portion insertable rearwardly into said opening, said engagement portion having an outer surface which faces towards said interior wall surface and includes a locking groove opening sidewardly toward said interior wall surface; and at least one plunger cartridge assembly mounted to said fixture housing and including a displaceable plunger which projects toward said locking groove of said lens and is engagable therewith for securing said lens within said opening.

2. The light fixture according to claim 1, wherein said cartridge assembly comprises a plunger body, said plunger, which is movably supported by said plunger body, and a biasing member for biasing said plunger toward said lens.

3. The light fixture according to claim 2, wherein said cartridge assembly is preassembled and said plunger body is affixed to said fixture housing for supporting said plunger thereon.

4. The light fixture according to claim 3, wherein a plurality of said cartridge assemblies are affixed to said fixture housing.

5. The light fixture according to claim 1, wherein said fixture housing includes a flange extending about said opening and to which each said cartridge assembly is attached.

6. The light fixture according to claim 5, wherein said flange includes connector members which secure said cartridge assembly on a rearward side thereof.

7. The light fixture according to claim 6, further comprising an annular collar which surrounds said housing end and receive and enclose said cartridge assembly therein wherein said annular collar and said enclosed cartridge assembly are positioned so as to be disposed exteriorly of the environmental structure to which said light fixture is configured to be adapted.

8. A light fixture mountable on an environmental structure, comprising:

a fixture housing having a side wall with an interior wall surface and having a front opening at a front housing end which is defined by said interior wall surface proximate a front side wall edge such that said front opening opens forwardly;

a light source disposed in said fixture housing so as to transmit light from said front opening;

a light transmitting lens which fits into and overlies said front opening and said light source disposed in said fixture housing, said lens including a skirt portion projecting rearwardly and insertable into said front opening, said skirt having an outer surface which faces towards said interior wall surface and includes a locking groove opening sidewardly toward said interior wall surface; and at least one plunger cartridge assembly mounted to said fixture housing proximate said front housing end and including a displaceable plunger which projects into said front opening toward said locking groove of said lens and is engagable therewith for securing said lens within said front opening, said cartridge assembly comprising a plunger body, which is affixed to said fixture housing, and said plunger, which is movably supported by said plunger body and resiliently biased toward said lens, said cartridge assembly being pre-mounted to said fixture housing as an assembly which is mountable to a support structure.

9. The light fixture according to claim 8, wherein said support structure is the environmental structure to which said light fixture is mounted directly with at least a portion of said fixture housing mounted interiorly within said environmental structure.

10. The light fixture according to claim 9, which further includes an annular collar which surrounds said front housing end and includes open interior portions which receive and enclose said cartridge assembly therein wherein said annular collar and said enclosed cartridge assembly are positioned so as to be disposed exteriorly of the environmental structure to which said light fixture is mountable.

11. The light fixture according to claim 8, wherein said fixture housing includes an annular flange extending about said front opening and to which each said cartridge assembly is attached, and said flange includes connector members which secure said cartridge assembly thereto.

12. The light fixture according to claim 8, wherein said cartridge assembly is preassembled and said assembly is mounted to said fixture housing with said plunger body affixed to said fixture housing for supporting said plunger thereon.

13. A light fixture mountable on an environmental structure, comprising:

a fixture housing having a side wall and a front opening at a front housing end proximate to a front side wall edge such that said front opening opens forwardly;

a light source disposed in said fixture housing so as to transmit light from said front opening;

a light transmitting lens which fits into and overlies said front opening and said light source disposed in said fixture housing so as to transmit light therethrough, said lens including a mounting portion insertable into said front opening, said mounting portion having an outer surface which faces towards said interior wall surface and includes at least one locking groove opening sidewardly toward said fixture side wall;

at least one plunger cartridge assembly mounted to said fixture housing proximate said front housing end and including a displaceable, resiliently biased plunger which projects into said front opening into engagement with said locking groove of said lens, said cartridge assembly comprising a plunger body which is affixed to said fixture housing and movably supports said plunger; and an annular collar which surrounds said front housing end and encloses said cartridge assembly therein wherein said annular collar and said enclosed cartridge assembly are positioned so as to be disposed exteriorly of the environmental structure to which said light fixture is mountable.

14. The light fixture according to claim 13, wherein said cartridge assembly is preassembled and said assembly is mounted to said fixture housing with said plunger body affixed to said fixture housing for supporting said plunger thereon.

15. The light fixture according to claim 13, wherein said fixture housing includes an annular flange extending about said front opening, and said flange includes connector members which secure said cartridge assembly to said flange rearwardly of said lens.

16. The light fixture according to claim 15, wherein said fixture housing permits the passage of said plunger sidewardly therethrough.

17. The light fixture according to claim 16, wherein said connector members comprise tabs bent rearwardly from said flange.

18. The light fixture according to claim 13, wherein said lens is engaged with said plunger by rotation of said lens, and said side wall further has a lock member secured thereto which engages said lens sidewardly to prevent disengaging rotation of said lens.

* * * * *